US008408887B2

(12) United States Patent
Brivio

(10) Patent No.: US 8,408,887 B2
(45) Date of Patent: Apr. 2, 2013

(54) PERISTALTIC PUMP

(75) Inventor: Marina Anna Brivio, Milan (IT)

(73) Assignee: Hemodec S.r.l., Salerno (IT)

( * ) Notice: Subject to any disclaimer, the term of this patent is extended or adjusted under 35 U.S.C. 154(b) by 516 days.

(21) Appl. No.: 12/442,673

(22) PCT Filed: Sep. 25, 2007

(86) PCT No.: PCT/IT2007/000664
§ 371 (c)(1),
(2), (4) Date: Mar. 24, 2009

(87) PCT Pub. No.: WO2008/038326
PCT Pub. Date: Apr. 3, 2008

(65) Prior Publication Data

US 2010/0086421 A1 Apr. 8, 2010

(30) Foreign Application Priority Data

Sep. 26, 2006 (IT) ..... MI2006A1816

(51) Int. Cl.
*F04B 43/12* (2006.01)
*B65D 85/68* (2006.01)

(52) U.S. Cl. ..... 417/477.6; 417/474; 417/477.8

(58) Field of Classification Search ..... 417/474–477.1, 417/477.5–477.8
See application file for complete search history.

(56) References Cited

U.S. PATENT DOCUMENTS

| | | | | |
|---|---|---|---|---|
| 5,055,001 | A * | 10/1991 | Natwick et al. | 417/63 |
| 5,357,827 | A * | 10/1994 | Natwick et al. | 74/569 |
| 5,511,951 | A * | 4/1996 | O'Leary | 417/53 |
| 5,741,121 | A | 4/1998 | O'Leary | |
| 5,938,413 | A | 8/1999 | Makino et al. | |
| 6,234,773 | B1 | 5/2001 | Hill et al. | |

FOREIGN PATENT DOCUMENTS

| | | | |
|---|---|---|---|
| DE | 197 29 612 | A1 | 1/1999 |
| EP | 0 446 897 | A2 | 9/1991 |
| EP | 1 350 955 | A2 | 10/2003 |
| GB | 1 141 800 | A | 1/1969 |
| GB | 2 179 404 | A | 3/1987 |

* cited by examiner

*Primary Examiner* — Joseph L Williams
(74) *Attorney, Agent, or Firm* — The Webb Law Firm

(57) ABSTRACT

A peristaltic pump having a plurality of pressors which compress a tube portion according to an orderly sequence. The pump is capable of determining a fluid flow inside the tube portion. The pressors are balancing or tilting pressors pivoted around a mutual axis and operated by corresponding motion means, which push the pressors against a plane or reaction element, contrasting the pressure of the same pressors on the tube containing the fluid to be pumped.

8 Claims, 5 Drawing Sheets

PERISTALTIC PUMP

BACKGROUND OF THE INVENTION

1. Field of the Invention

The present invention relates to a peristaltic pump. In particular, the invention relates to a linear peristaltic pump acting by means of a lateral pressure, provided with tilting elements, which has various distinctive features which will be described in the following. The application fields of the present invention are preferably the medical field, in which it can be used as a blood pump in extra-corporeal circulation machines, as a machine for handling medical fluids, medicines, in dialysis and in hemofiltration machines and in the industrial field it can be used as a dosing pump, generally with medium-low capacities, indicatively under 20 liters per minute.

2. Description of Related Art

A peristaltic pump according to the present invention offers numerous advantages during functioning, during loading and also in productive economy.

One of the problems which can be solved thanks to the present invention relates to the crushing of the tube on which the pump acts; in fact, in well-known pumps, whose tube is substantially totally compressed, a crushing may occur and cause sudden accelerations of the liquid contained in the pumps, or turbulent flows and undesired hydrodynamic effects. These effects would lead to violent turbulent flows, would compromise the duration of the tube, and, especially, would compromise the integrity of the solid components transported by the fluid itself, like in the case of blood.

SUMMARY OF THE INVENTION

Thanks to the present invention, instead, the action of the pump on the fluid is extremely sweet and, in the case of blood, far less traumatic than in conventional peristaltic pumps.

A further advantage of the invention arises from the fact that said pump acts on a tube segment which is rectilinear instead of being curved like in conventional peristaltic pumps and this leads to a consequent reduction of the tube stress and lengthens its medium life.

A further advantage relates to the uniformity, that is to say with the continuity of the flow determined by the action of a pump according to the present invention. As described more in detail in the following, it is possible to operate two opposite balancing or tilting pressors by means of the pump of the present invention and to obtain two pressure waves in phase opposition. These pressure waves, if added together, besides producing the double of the original flow, can remarkably reduce the discontinuity of the flow itself since one pump segment sucks (and it consequently does not push) while the other pump segment pushes. (This continuity reaches the utmost quality degree using two couples of pressors).

A further advantage of the invention relates to the loading of the pump, that is to say relates to the association of the pump to the tube on which the pump acts: this operation is extremely easy, particularly advantageous, time-saving and it reduces the possibility of potential errors; there is no need of qualified personnel and furthermore it makes the process automatic.

A further advantage is connected with productive economy as, in the embodiment described below, the balancing (tilting) elements may consist of simple metal pieces featuring a suitable shape and size which do not require special precautions or grinding treatments, since they do not slide inside bushings, they limit themselves to oscillations of few degrees on their axes.

A further advantageous feature of the invention is connected with the structure of the pressors which can advantageously be divided into many parts so as to push the liquid to be pumped much more gradually, especially during the final phase of the tube crushing. Said features offer evident advantages in blood treatments or in treatments of damageable fluids when they are submitted to pressures and/or high speeds; the same feature is particularly advantageous whenever some mechanically resistant tubes are crushed.

BRIEF DESCRIPTION OF THE DRAWINGS

The technical features of the invention according to the purposes mentioned above are clearly explained in the following claims and the advantages of the invention will become more evident in the following description, with reference to the enclosed drawings which show an exemplificative but non limitative embodiment, wherein:

DETAILED DESCRIPTION OF THE INVENTION

With reference to the enclosed drawings, in its basic structure, a pump (P) consists of three balancing pressors (1,2,3) pivoted around a mutual axis (X) operated by three corresponding cams (5) disposed on the same axis (k) and pushed against a reaction plane which contrasts with the pressure of the balancing elements on the tube (T) containing the liquid to be pumped.

With a particular reference to FIGS. 1-4, the pump (P) can be supported by a support structure (10) which can have a box-like shape and be upperly closed by a cover (11) which is shown separated from the structure (10).

Figure 1:
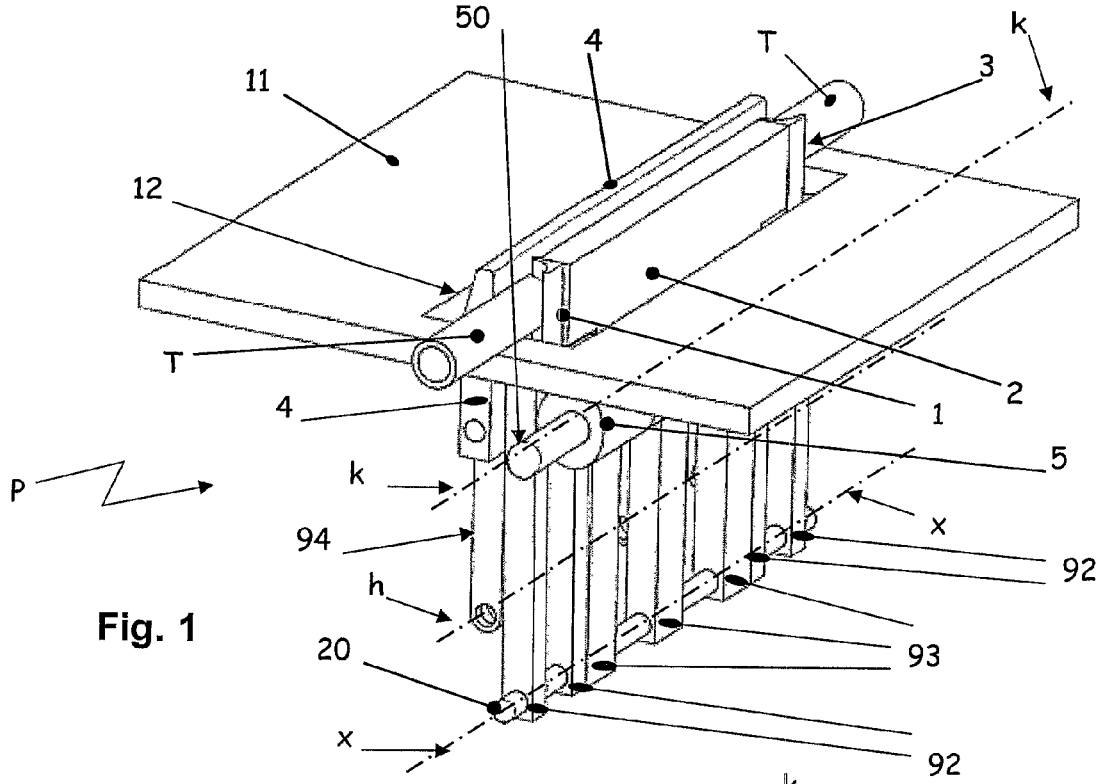
FIG. 1 schematically shows a partial perspective view with omitted parts of a possible embodiment of a pump according to the invention.
Figure 2:
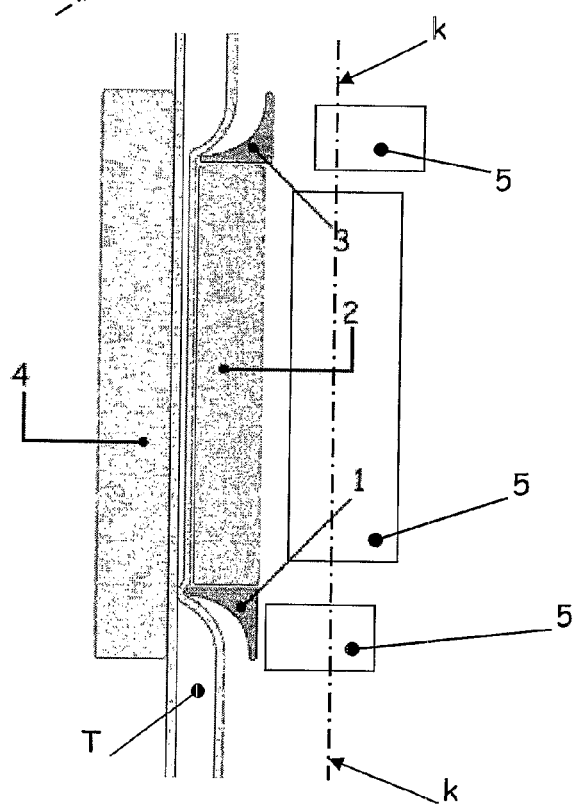
FIG. 2 refers to a partial schematic top plan view of some pump components.
Figure 3:
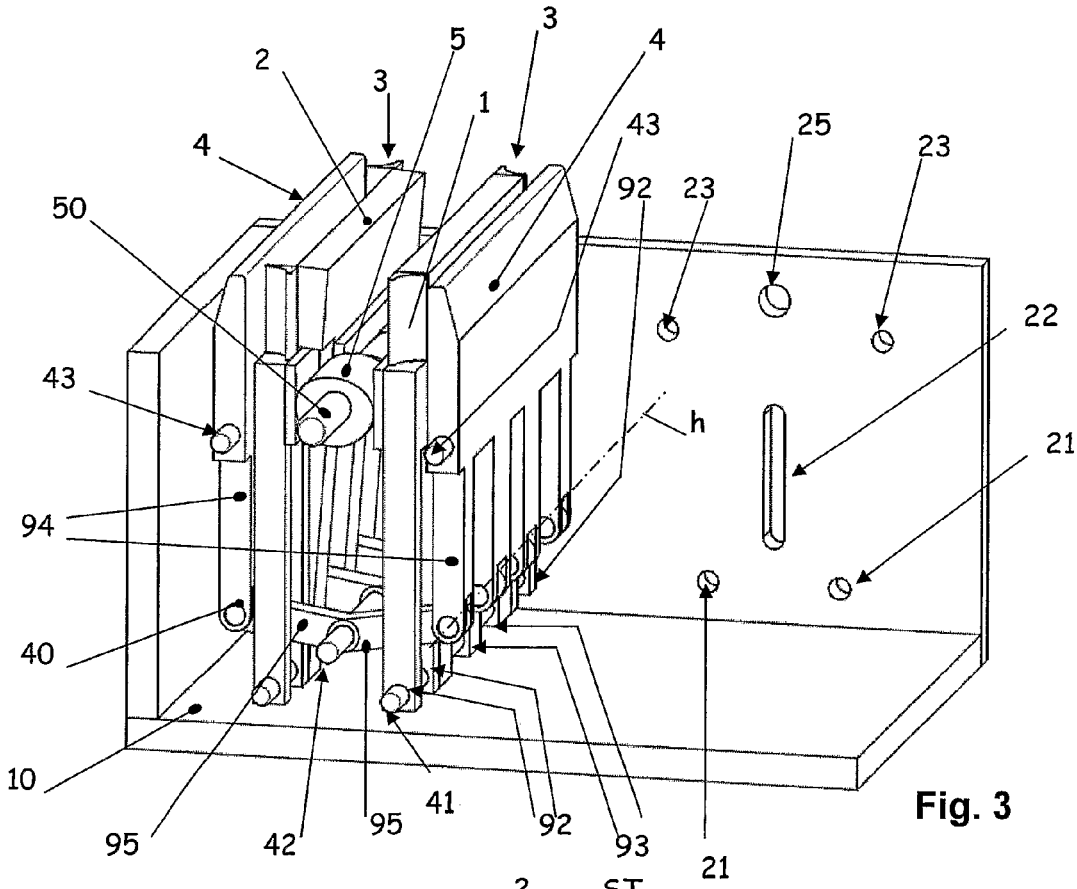
FIGS. 3 and 4 show a pump according to the invention which is represented in two different operating phases, in corresponding partial perspective views with omitted parts.
Figure 4:
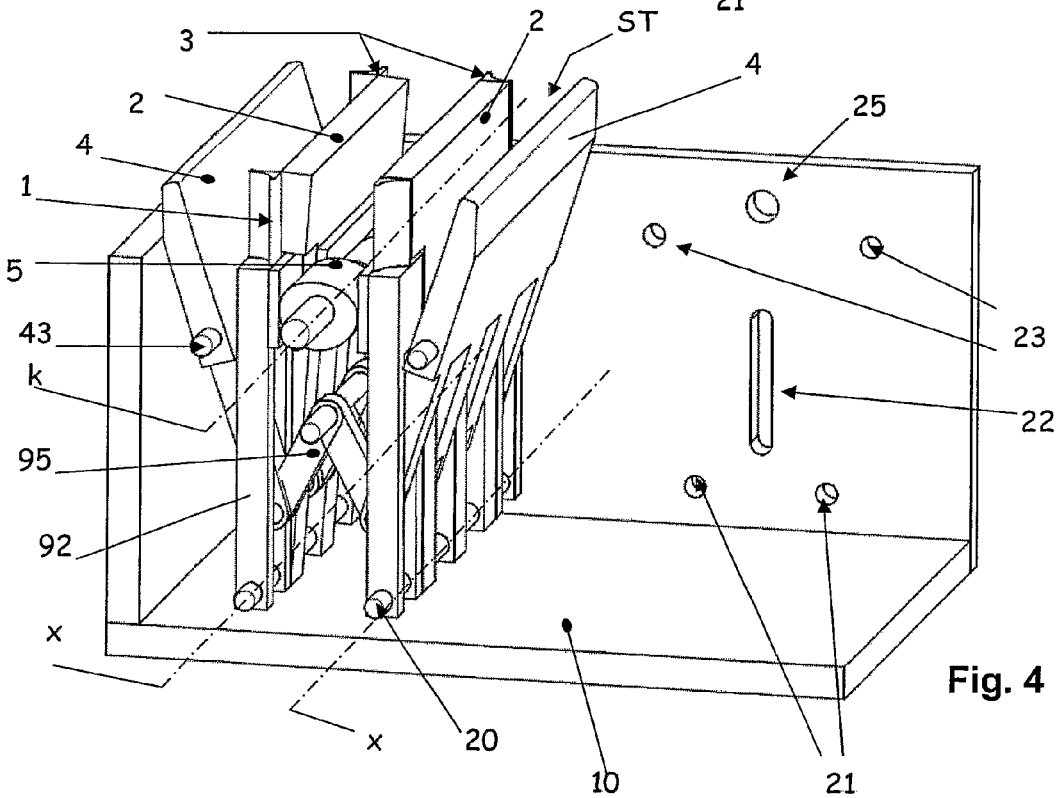

The cover (11) is provided with one or more holes (12) for the passage of the pressors (1, 2, 3) and of the reaction elements (or reaction planes) (4). FIG. 1 shows a simplified embodiment for the pumping on a single tube portion (T), so the cover has only one hole (12); it is possible to guess that the number of holes presented by the cover corresponds to the number of pump pressors, that is to say to the number of tube portions on which it is possible to act. In the example of FIGS. 3 and 4 the pump is capable of carrying out pumping on four tube portions; said figures illustrate the pump in a partial view because; in order to better illustrate its structure and its functionality, they show the pressors and reaction elements for two of the tube portions only.

As previously said, the three balancing pressors (1, 2, 3) are pivoted around their mutual axis (x). In particular, the pivot point corresponds, substantially, to the proximal end (disposed lowerly in the drawings) of said pressors, being the distal end of said pressors destined to act on the tube (T). A shaft (20) passes through each pressor (1, 2, 3) and said shaft coincides with said axis (x) and is inserted in corresponding seats (21) provided on counterposed holes of the support structure (10) (In FIGS. 4 and 5, the front wall, the right wall and the cover are not represented). In the examples shown, moreover, the pressors (1, 2, 3) consist of a multi-prong lever; in particular, the lever of each lateral element (1, 3) is a two-prong lever (92), while the lever of the central element (2) which is larger than the two lateral elements, is a three-prong lever (93). The prong structure of the central and proximal portions of the levers allows the passage of other levers (94) destined to support the reaction elements (4). The levers (94) are connected to the reaction element (4) (disposed upperly in the drawing) in their distal end, so as to form a whole with said element, while at their proximal end they are hinged around corresponding pivots (40) disposed on an axis (h) which is parallel to said axis (x). Two small shafts (43) are provided on the sides of the reaction elements (4) and housed in corresponding seats (23) presented by the structure (10).

With reference to FIGS. 3 and 4, a central shaft (42) is foreseen parallel to said shafts (20) and pivots (40). Said central shafts (42) can slide vertically in a corresponding slot seat (22) foreseen on the structure (10). Two couples of arms (95) connecting said shaft (42) to a couple of corresponding levers (94) by means of said pivots (40) are hinged on the central shaft (42).

The pump (P) is complete with the shaft (50) (axis k) on which the two cams (5) are keyed and said shaft is housed in two seats (25) which are in a counter-posed position on the walls of the structure (10).

As previously said, the balancing (tilting) elements are three: the two external elements (1, 3) which act as input and output valves and alternatively compress a very short portion of the tube (6) so as to obtain a complete occlusion, and the central element (2) which has a greater length (indicatively in the range of ten times the diameter of the tube itself but not limited to this value only) and compresses the tube so as to produce a volume variation which causes a real pumping effect.

The realisation of a central element featuring said length value (ten times the diameter of the tube) proved extremely effective during experimentation.

As the compression of the tube portion (T) submitted to the action of the pump (P) takes place parallel to the tube itself and the volume reduction inside the tube is the same along the whole tube extension submitted to the pumping action, the central element (5) must not compress the tube until it is completely occluded and this to avoid crushing which, in the final phase of the run, would cause sudden accelerations or turbulent flows of the liquid contained in it, or other undesired hydrodynamic effects. These effects would cause flow perturbations, compromise the duration of the tube and, above all, the integrity of the solid components transported by the fluid itself, like in the case of blood.

On the contrary, if a dead space is always left, the value of which is nearly or higher than 5% of the tube diameter itself (that is indicatively comprised between 5% and 15%), the action of the pump on the fluid is extremely sweet and, like in the case of blood, far less traumatic than in conventional peristaltic pumps. During some experimental tests, said value, which was basically nearly 10% gave satisfactory results thanks to the effectiveness of the pumping and, in the case of blood, to the preservation of the natural features of the fluid already treated.

The pumps functions according to the following cyclical phases: the first balancing element (1) which will be called "input valve" and which is operated by a cam moves from its open position and completely occludes the short tube portion submitted to its action (as exemplifyingly shown in FIG. 2), the other balancing elements (2, 3) not acting on the tube in this phase; at this point the central balancing element (2) which will be called "pressor", operated by the cam (5) commanding it, starts the compression on its tube portion so as to cause the outflow of the liquid to be pumped from the open end of the tube. As soon as the "pressor" (2) reaches the end of its run (although a certain percentage of liquid is left inside the tube to avoid crushing) the third balancing element (3), which will be called "output valve" is pushed by its own cam (5) so that it completely occludes the corresponding tube and, at the same time, the "input valve" (1) starts to open, while the central "pressor" (2) draws back to allow the tube to recover its original shape and to recall by depression the liquid to be pumped through the "input valve" (1). As soon as the tube is completely filled with liquid, that is to say when the "pressor" (2) has reached its maximum opening position, the cycle starts again.

The action of the pump (P) on a rectilinear tube portion instead of on curved tube portion like in conventional peristaltic pumps reduces the tube stress and lengthens its medium life.

A further advantageous feature will be described with reference to the diagrams of FIGS. 7 and 8. As previously said, the pump of the present invention acts on parallel tube portions connected each other upstream and downstream of the same pump; in practice, upstream of the pumping zone the tube which transports the fluid to be pumped is divided into a plurality of parallel tracts which join again downstream pump (P). As the same cam (5) can advantageously operate two opposite balancing elements (that is to say a couple of homologous balancing elements disposed on two different coupled shafts 20 like in FIGS. 3 and 4 for example) so as to obtain two pressure waves in phase opposition that, if added together, besides producing the double of the original flow, after the tube portions underneath each of them has been joined so as to form a single tube, can remarkably reduce the discontinuity of the flow because one tube portion sucks and it obviously does not push while the other tube portion, instead, pushes.

Figure 7:
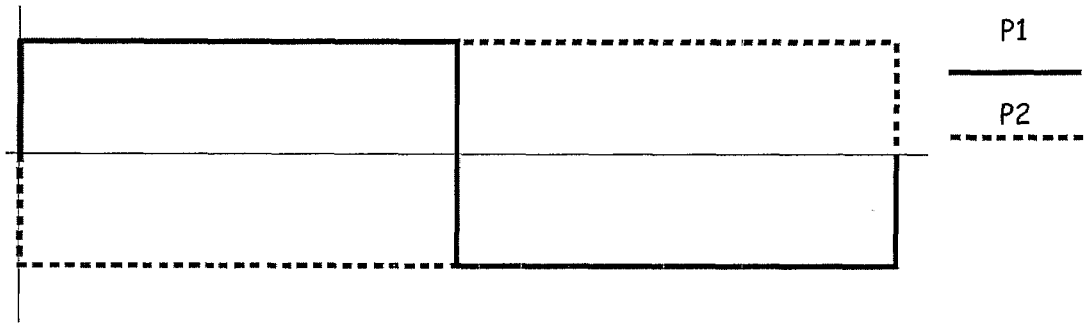
FIGS. 7 and 8 refer to two flow diagrams showing the flow range according to two different configurations of a peristaltic pump.
Figure 8:
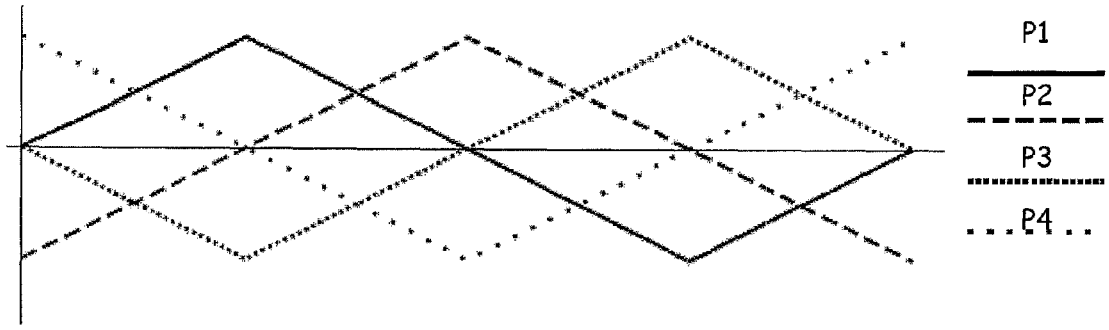

If only two balancing pressors are used (as shown in the diagram of FIG. 7 where P1 and P2 indicate the action of two pump units each comprising the three balancing elements 1, 2, 3 described below) it is not possible to obtain a continuous flow because it would be necessary to obtain a square wave which cannot be physically reached due to the theoretically infinite acceleration necessary to change from a full suction condition to a full thrust condition within two subsequent instants. According to one aspect of the present invention, this flow continuity feature can be easily obtained by using two series of cams, that is four series of balancing pressors (P1, P2, P3, P4). A suitable cam profile will lead to a tube compression in order to produce a series of "triangular waves" which, if added together, will provide a theoretically continuous flow both during thrust and during suction.

Figure 11:
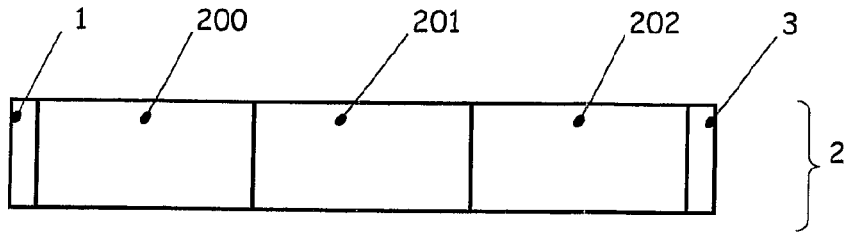
FIG. 11 schematically shows a possible embodiment of a pressor according to the invention seen in a schematic plan view.

FIG. 11 shows a possible embodiment of the central element (2). In this embodiment, the central element (2) is interposed between the two lateral balancing elements (1, 3) but it consists of three sections (200, 201, 202) which can be moved independently from one another. In particular, after the tube has pressed the central element (2) it is possible to obtain an action in sequence from the upstream direction to the downstream direction of said sections (200, 201, 202). In particular, during the pressure operated on the tube by the central element (2), it is possible to obtain a sequence of action, from upstream to downstream, of said sections (200, 201, 202). In this way, it is possible to avoid an excessive pressure on the fluid by subdividing the action zone of the central element during the final phase of tube crushing; this to prevent the central element (2) from crushing the tube with a value corresponding to its whole length during the final phase of its action because this would lead to a thrust acceleration of the fluid contained in the tube and said acceleration could damage the fluid, especially if the fluid is blood. In other words, thanks to the solution shown in FIG. 11, instead of using a pressor with a relatively great length completing its action on the tube along the whole extension of the elements, it is possible to obtain a progressive crushing of the tube from the upstream direction to the downstream direction so as to crush the tube at the maximum level in a progressive manner instead of crushing it in a sudden manner. Said feature is extremely important for a correct blood treatment and for all those substances that could be damaged by a sudden acceleration while they are flowing inside the tube. Moreover, the feature concerning the subdivision of the tube is advantageous when a force is applied during the crushing of relatively mechanically resistant tubes (hard tubes) because it is possible to apply a force on each pressure portion (2) which is inferior to the force generally applied to a corresponding pressor consisting of a single unit.

In order to provide an easy pump loading, that is an easy positioning of the tube on the pump, the reaction plane (4) can be moved away from the pressors (1, 2, 3) for a value which is nearly that of the tube (T) diameter itself. As an alternative, it is possible to move the pressors away from the reaction plane during the loading operation, for example they can be lowered by a few centimeters so that the pressors can be moved away from the reaction plane.

The first solution is illustrated in the drawings of FIGS. 3 and 4, in a form which is illustrative and not limitative. The upward motion of the shaft (42) and its sliding along the slots (22) which takes place thanks to the action of motion means—which are not illustrated in the figures—, or is performed manually by an operator, causes the reaction elements (4) to move away, that is to say it causes a temporary widening of the seat (ST) for the tube (T) (which is not illustrated in these drawings). In particular, the upward motion of the shaft (42) causes the reciprocal approach of the shafts (40) which are disposed adjacently to the lower ends of the reaction elements (4); since said reaction elements (4) are hinged around the shafts (43) (housed in seats 23 free to rotate), the reaction elements (4) rotate around the axes defined by the shafts (43) with a consequent temporary removal of the elements (4) from the pressors (1, 2, 3), that is with the widening of the seat (ST) above mentioned. FIG. 4 shows the loading phase during which it is possible to introduce the tubes (T) while FIG. 3 shows an active configuration or pumping configuration.

Figure 5:
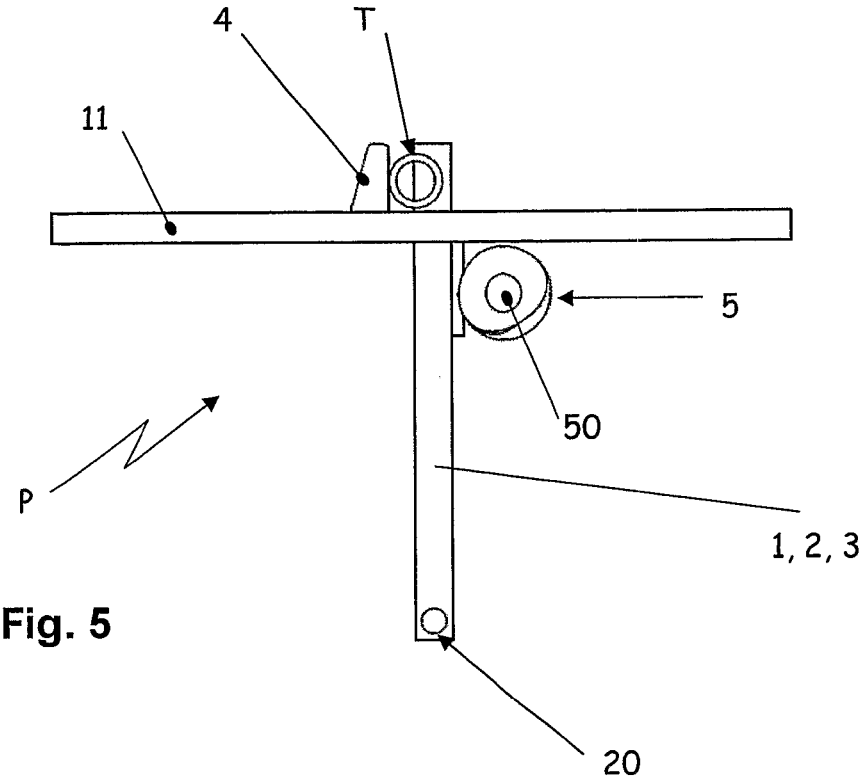
FIGS. 5 and 6 show a further embodiment of a pump according to the invention in corresponding partial lateral views with omitted parts, in two different operating phases.
Figure 6:
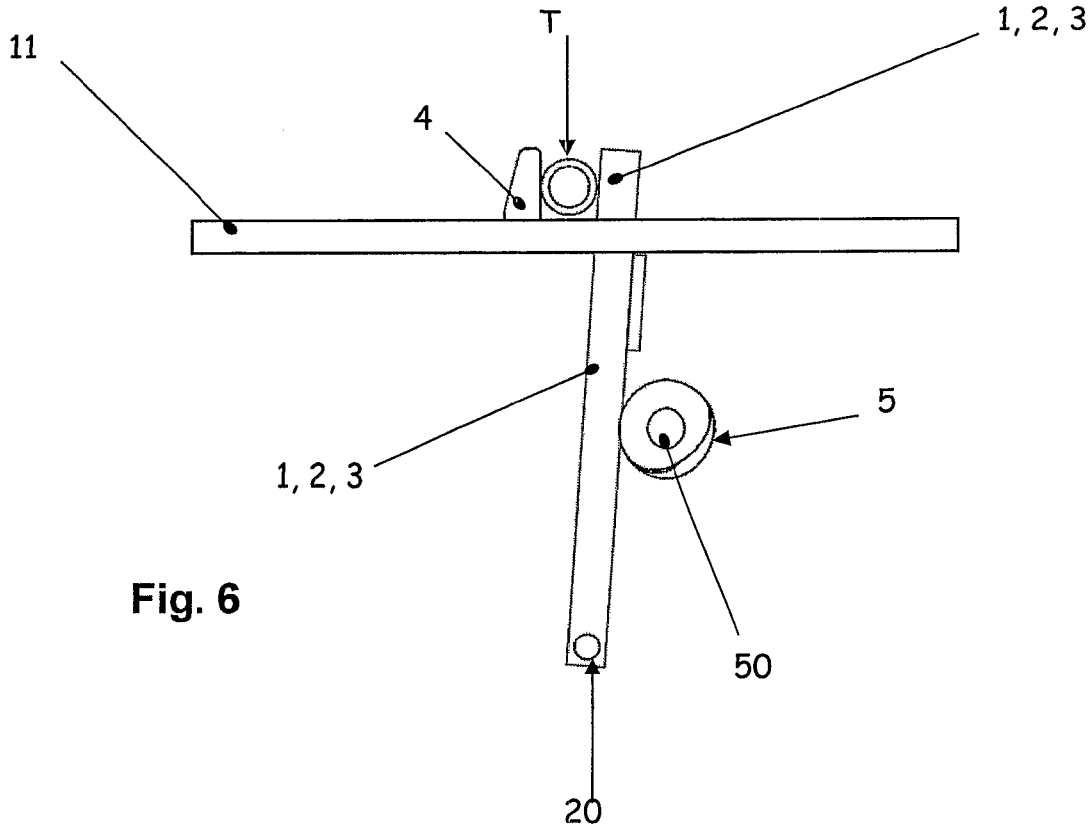

FIGS. 5 and 6 show an embodiment where the tube loading is obtained by moving the pressors (1, 2, 3) away, with reference to a single tube only (T) for the sake of simplicity; some parts are omitted to describe other parts more in detail. In this example, the reaction plane (4) builds up a single unit with the cover (11) of the support structure, that is to say it is integral to the cover itself. To allow the insertion of the tube/tubes (T) between the reaction plane (4) and the balancing elements (1, 2, 3), the shaft (50) which supports the cams (5) is moved downward as shown in FIG. 6 so as to widen the opening between said elements (1, 2, 3) and the plane (4). FIG. 5 shows a non crushed tube (T) to highlight the difference with respect to FIG. 6.

Figure 9:
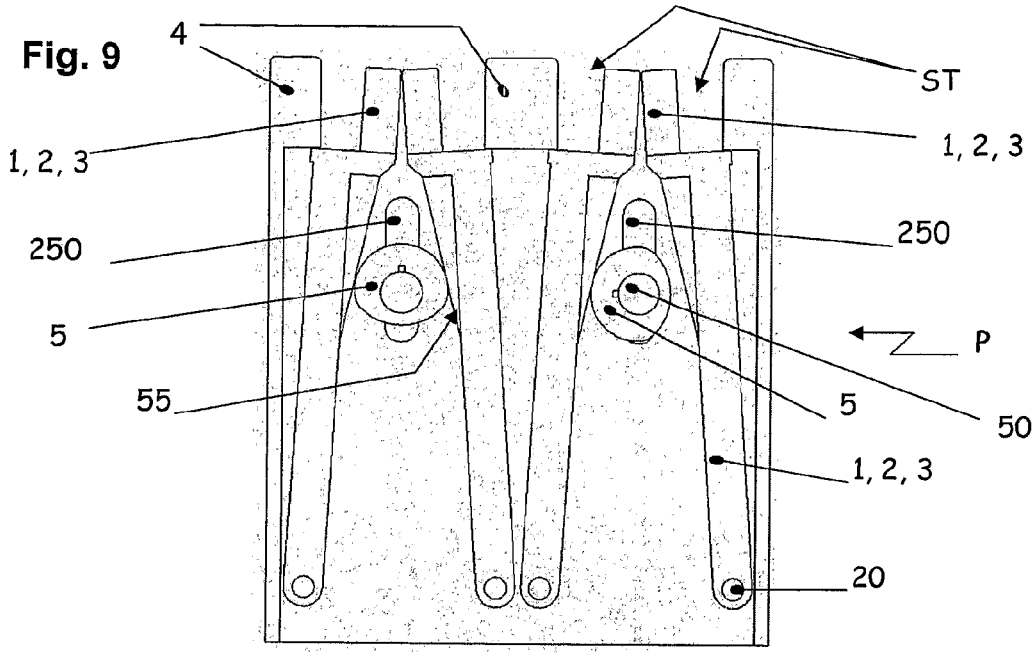
FIGS. 9 and 10 show a possible embodiment of the invention which is analogous to that of FIGS. 5 and 6 and illustrates the action on many tube portions, represented in a schematic lateral view in two different operating phases.
Figure 10:
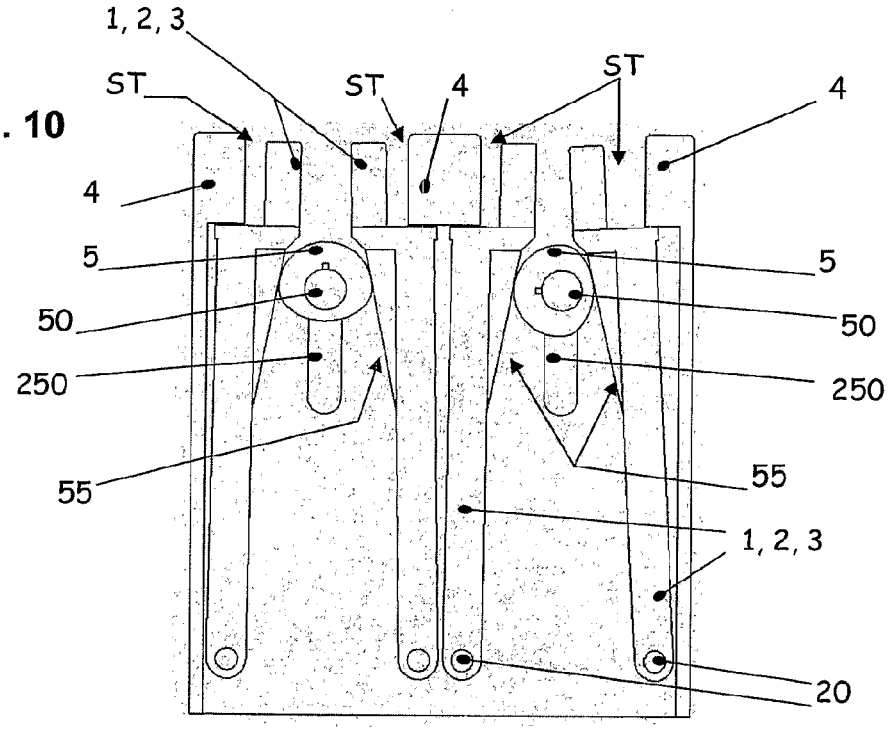

In FIGS. 9 and 10 the loading modalities are analogous to those shown in FIGS. 5 and 6. FIGS. 9 and 10 show the seats (ST) for four tubes (which are not illustrated), seats which are defined by the reaction elements or reaction planes (4) and by the balancing elements or pressors (1, 2, 3). Said pressors are exemplifyingly represented by a single element pivoted around the shaft (20) and marked with the numerical references of all the three elements (1, 2, 3). The reaction planes (4) are fixed that is to say they are integral to the pump structure (P). In order to allow the pump loading, the cams (5), which are supported by corresponding shafts (50), are lowered (see the configuration shown in FIG. 9) thanks to a sliding of the shafts (50) along corresponding seats (250) foreseen on the walls of the structure (10). The lowering of the cams (5) determines the removal of each balancing element (1, 2, 3) from the homologous reaction plane (4) and allows the introduction of the tubes into the space so provided. In order to carry out the pumping operation, the cams (5) are brought into the upper position shown in FIG. 10 (automatically, using motion means, or manually by an operator) where the same cams (5) can interact with corresponding slides (55) foreseen on the balancing elements (1, 2, 3). The rotation of the shafts (50), which can advantageously be enabled only when the same shafts are in the upper position, determines the rotation of the cams (5) and their interaction with the slides (55); said slides (55) have an oblique profile so as to interfere with the cams (5) only if these are in the upper position or active position (5). The profile of the cams (5), thanks to its structures, provide a corresponding movement to the balancing elements (1, 2, 3) and determine a series of sequential actions on the tubes housed in the seats (ST). In fact, as previously said, the pump acts on various parallel tube portions which are connected to one another upstream and downstream of the pump itself so as to determine a series of pressure waves which, downstream of the pump produce a continuity and regularity effect in the flow described above. The example of FIGS. 9 and 10 shows the cams (5) acting on tube sections disposed adjacent to one of the balancing elements (1, 2, 3). In the pump the number of cams acting on each tube corresponds to the number of provided tilting elements and to the number of possible portions into which the elements can be subdivided, like in the case of the central element subdivided into more portions (see example in FIG. 11). The profiles of the cams (5) will consequently feature structures which determine orderly and predetermined action sequences on different tubes and on tube portions which follow one another from upstream to downstream.

An easy loading is a remarkable advantage and reduces idle times and potential errors, the need of qualified personnel and most of all it makes the process automatic. In the case of the present invention, in fact, it is sufficient to provide a simple support which disposes the tubes at the correct distance and in the right position; after positioning the support with the tubes on the pump (or on the pump unit) with open reaction planes in the "loading" condition, the pump can automatically or manually be closed on the tubes and start to function.

The support (not necessarily a monouse support) can be a very economical one (a common plastic sheet with a suitable thickness or even cardboard) as its only function is that of holding the underpump tubes in their right position until the pump closes. The support can obviously be adapted to support a series of components which usually accompany this type of pump especially in the medical field (hemofilters, manometers, blood sacks and so on) and various pumping elements may be present in the same pumping equipment to pump various liquids (blood, medicines, dialised or ultrafiltered plasma, dialysis liquids and so on) with independent functioning and with different sizes, speeds and capacities. In this case, a single support can contain all the underpump tubes and all the line elements necessary to complete the circuit and the corresponding therapy.

As regards productive economy, the balancing elements are simple metal pieces having suitable shapes and sizes which do not require special precautions or grinding treatments as they do not slide inside bushings, they limit themselves to oscillations of few degrees on their axes. The only element which is quite expensive and determines the regularity of the pump is the cam whose profile allows the operator to obtain the desired flow but it should be remembered that a single cam can act on two tube segments and double the efficiency of the system in an economical manner. Cams can be replaced with conventional crank gears in case particular working pressures require their use to avoid friction of the cam on the follower. The invention described above is subject to numerous changes, all within the concepts of the invention. Moreover, all the details can be replaced with technically equivalent elements.

The invention claimed is:

1. A peristaltic pump comprising:

a plurality of pressors which compress a tube portion according to an orderly sequence, capable of determining a fluid flow inside said tube portion, wherein the pressors are balancing or tilting pressors pivoted around a mutual axis and operated by corresponding motion means which push said pressors against a reaction element contrasting the pressure of the same pressors on the tube containing the fluid to be pumped and wherein said peristaltic pump is provided with means for separating all said pressors from the reaction element at the same time, said means for separating being formed by a lever element connected to said pressors or to said reaction element and wherein said pressors are pivoted around the mutual axis and operated by corresponding cams disposed on a corresponding cam axis, wherein a mutual axis shaft passes through said mutual axis in correspondence with the proximal end of each of said pressors and wherein the distal end of said pressors act on said tube portion;

a support structure, that supports the pump, which has a box-like shape and which is upperly closed by a cover, said cover being provided with one or more holes for the passage of said pressors and said reaction elements;

a pivot point of said pressors which corresponds substantially to the proximal end of the same pressors and in which the distal end of said pressors act on the tube;

a shaft which passes through each pressor, said shaft coinciding with said mutual axis and being inserted in a couple of corresponding seats placed counter-posed on said support structure;

a multi-prong lever of said pressors having a prong structure which allows the passage of other levers destined to support the reaction elements; said other levers being connected to the reaction element in their distal end, while at their proximal end are hinged around corresponding pivots disposed on an axis which is parallel to said mutual axis of pressors;

small shafts provided on the sides of the levers forming said reaction elements, said small shafts being housed in corresponding seats presented by the structure;

a central shaft disposed parallel to said mutual axis shafts and to said pivots, said central shaft being vertically slidable in corresponding slot seat of the support structure;

two couples of arms connecting said central shaft to a couple of said other levers by means of said pivots which are hinged on the central shaft; and, a further shaft, parallel to said shaft of mutual axis, supports said cams housed in a couple of seats placed counter-posed on said support structure, wherein:

the motion of said central shaft with its sliding along the slot seats causes the reaction elements to move away from said pressors;

the plurality of pressors comprises a central pressor and two lateral pressors, the lateral pressors by alternatively compressing a very short tract of the tube so as to completely occlude it, define corresponding inlet and outlet valves; and, the central pressor extends parallel to said tube with a higher value with respect to the lateral pressors and compresses the tube so as to produce the volume variation which determines the pumping effect.

2. The peristaltic pump of claim 1, wherein the motion means consist of a plurality of cams disposed on the same axis.

3. The peristaltic pump of claim 1, wherein the motion means are disposed long a rectilinear front so as to act on a corresponding rectilinear tube portion.

4. The peristaltic pump of claim 1, wherein the central pressor has a length extension which is about ten times the diameter of the tube itself.

5. The peristaltic pump of claim 1, wherein the central pressor compresses said tube and crushes it up a percentage of about 5% the tube diameter.

6. The peristaltic pump of claim 1, comprising many series or groups of pressors which act on corresponding tube portions connected to one another upstream and downstream of the pump itself.

7. The peristaltic pump of claim 1, wherein the central pressor is subdivided into a plurality of portions along its longitudinal development, from upstream to downstream according to the flow path of the liquid present inside the tube.

8. The peristaltic pump of claim 1, wherein:

said pressors are levers pivoted around the mutual axis and operated by corresponding cams disposed on a corresponding cam axis, wherein a shaft passes through said mutual axis in correspondence with the proximal end of each of said pressors wherein the distal end of said pressors act on said tube portion;

the reaction element forms a single unit with said cover of the support structure, that is to say it is integral to the cover itself; and, the motion of said further shaft which supports the cams with its sliding along the relevant slots causes the reaction pressors to move away from said reaction element.

* * * * *

UNITED STATES PATENT AND TRADEMARK OFFICE

CERTIFICATE OF CORRECTION

PATENT NO. : 8,408,887 B2
APPLICATION NO. : 12/442673
DATED : April 2, 2013
INVENTOR(S) : Marina Anna Brivio It is certified that error appears in the above-identified patent and that said Letters Patent is hereby corrected as shown below:

Title Page, Column 1, Item (30) Foreign Application Priority Data, Line 1, "MI2006A1816" should read -- MI2006A001816 --

In the Claims:

Column 8, Line 32, Claim 3, delete "long" and insert -- along --

Column 8, Line 38, Claim 5, after "up" insert -- to --

Signed and Sealed this
Eighteenth Day of June, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,408,887 B2
APPLICATION NO. : 12/442673
DATED : April 2, 2013
INVENTOR(S) : Marina Anna Brivio It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 642 days.

Signed and Sealed this
First Day of September, 2015

Michelle K. Lee

Michelle K. Lee
*Director of the United States Patent and Trademark Office*